US010267577B2

(12) United States Patent
Gunkel et al.

(10) Patent No.: US 10,267,577 B2
(45) Date of Patent: Apr. 23, 2019

(54) TUBE BUNDLE DEVICE AND USE THEREOF

(71) Applicant: BASF SE, Ludwigshafen (DE)

(72) Inventors: Wolfgang Gunkel, Mannheim (DE); Frank-Friedrich Pape, Kleinniedesheim (DE); Klaus Fouquet, Schifferstadt (DE)

(73) Assignee: BASF SE, Ludwigshafen am Rhein (DE)

( * ) Notice: Subject to any disclaimer, the term of this patent is extended or adjusted under 35 U.S.C. 154(b) by 287 days.

(21) Appl. No.: 14/783,278

(22) PCT Filed: Apr. 9, 2014

(86) PCT No.: PCT/EP2014/057126
§ 371 (c)(1),
(2) Date: Oct. 8, 2015

(87) PCT Pub. No.: WO2014/166981
PCT Pub. Date: Oct. 16, 2014

(65) Prior Publication Data

US 2016/0047608 A1 Feb. 18, 2016

(30) Foreign Application Priority Data

Apr. 11, 2013 (EP) ..... 13163352

(51) Int. Cl.
*F28D 7/00* (2006.01)
*F28F 9/02* (2006.01)
*F28D 7/16* (2006.01)

(52) U.S. Cl.
CPC ..... *F28F 9/026* (2013.01); *F28D 7/16* (2013.01); *F28F 9/0226* (2013.01)

(58) Field of Classification Search
CPC ..... F28F 9/026; F28F 9/0226; F28D 7/16
(Continued)

(56) References Cited

U.S. PATENT DOCUMENTS 1,091,369 A * 3/1914 Mejani ..... F28D 7/024 122/32
1,756,458 A * 4/1930 Gordon ..... F22D 1/42 165/134.1
(Continued)

FOREIGN PATENT DOCUMENTS

DE 102007031419 A1 1/2008
DE 102007024934 A1 12/2008
(Continued)

OTHER PUBLICATIONS

International Search Report for PCT/EP2014/057126 dated May 26, 2014.

*Primary Examiner* — Claire Rojohn, III
(74) *Attorney, Agent, or Firm* — Drinker Biddle & Reath LLP

(57) ABSTRACT

The invention relates to a shell-and-tube apparatus comprising a housing (3) having a bundle (9) of tubes accommodated therein, where the tubes (15) are joined on one side to a first tube plate (11) and on the side opposite the first tube plate (11) to a second tube plate (13), with the first and second tube plates (11, 13) being fastened detachably in the housing (3). The side of the first tube plate (11) opposite the tubes (15) rests against a stop (31) on the housing (3) and is fixed on the stop (31) and the second tube plate (13) is installed with a sealing element (41) in the housing (3). The invention further relates to the use of the shell-and-tube apparatus.

9 Claims, 2 Drawing Sheets

Figure 1:
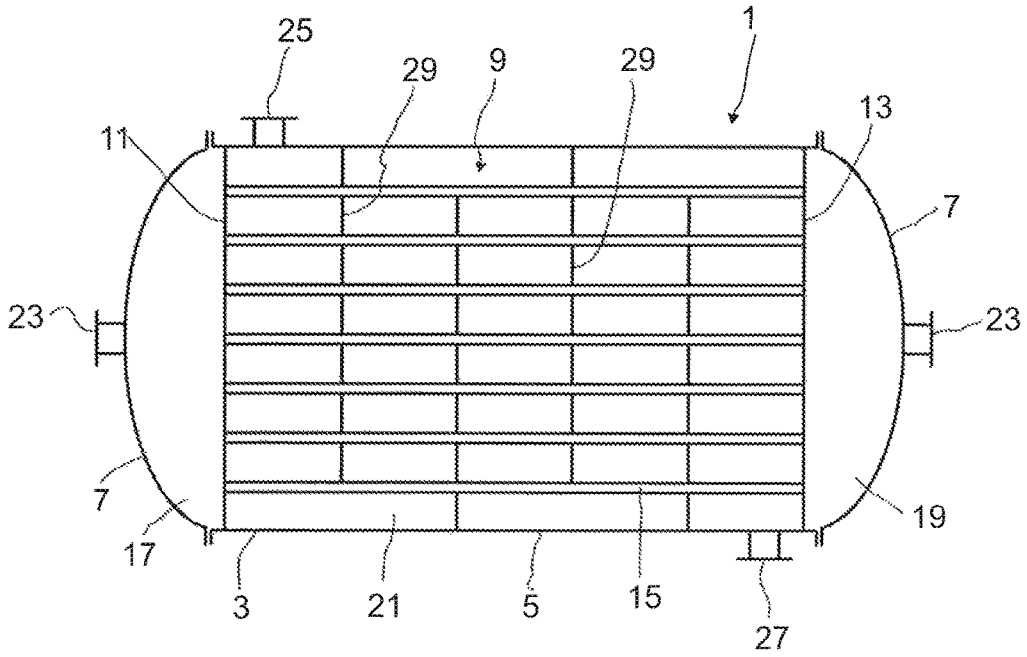

(58) Field of Classification Search
USPC ..... 165/159
See application file for complete search history.

(56) References Cited

U.S. PATENT DOCUMENTS 1,810,286 A * 6/1931 MacPhee ..... F28D 7/1646 165/11.1
2,223,320 A * 11/1940 Jacocks ..... F28F 9/0202 165/158
2,520,755 A * 8/1950 Brown, Jr. ..... F28D 7/06 165/158
2,690,275 A 9/1954 Alt et al.
2,857,142 A * 10/1958 Gertzon ..... F28F 9/0202 165/158
3,155,404 A * 11/1964 Brown, Jr. ..... F16L 39/00 165/111
3,377,087 A * 4/1968 Samerdyke ..... F16L 7/02 165/158
3,768,550 A * 10/1973 Williamson ..... F28F 9/00 165/158
3,948,315 A * 4/1976 Powell ..... F28D 7/06 165/70
4,200,061 A * 4/1980 Sterk ..... F22B 1/025 122/32
4,653,575 A * 3/1987 Courchesne ..... F24F 13/30 165/135
4,825,942 A * 5/1989 Helberg ..... F28F 9/0219 122/511
5,759,500 A * 6/1998 Garner ..... B01D 53/8631 422/201
5,823,251 A * 10/1998 Romero ..... B23P 19/022 165/158
7,128,137 B2 * 10/2006 Dilley ..... F28F 9/0219 165/158
7,147,048 B2 * 12/2006 Mitsumoto ..... B01J 8/067 165/157
7,152,665 B2 * 12/2006 Toh ..... F17C 1/00 165/74
7,837,954 B2 * 11/2010 Lehr ..... B01J 8/008 165/104.19
8,033,323 B2 * 10/2011 Schatz ..... F28D 7/1684 165/162
8,844,504 B2 * 9/2014 Raduenz ..... F28D 7/1684 123/568.12
8,925,624 B2 * 1/2015 Kuroyanagi ..... F28D 7/1692 165/157
8,978,740 B2 * 3/2015 Schatz ..... F28D 7/1684 165/69
9,403,204 B2 * 8/2016 Casterton ..... B21D 53/02
9,429,365 B2 * 8/2016 Postma ..... F28D 7/16
9,562,466 B2 * 2/2017 Day ..... F28D 7/1661
9,695,733 B2 * 7/2017 Drankow ..... F28F 9/0219
2007/0131401 A1 * 6/2007 Daly ..... B29C 65/1635 165/158
2008/0202724 A1 * 8/2008 Lorenz ..... F28D 7/0075 165/51
2008/0289804 A1 * 11/2008 Baumann ..... F28D 7/1692 165/157
2009/0008074 A1 * 1/2009 Vamvakitis ..... F28D 7/0083 165/177
2009/0056922 A1 * 3/2009 Hemminger ..... F28F 9/02 165/158
2010/0025023 A1 * 2/2010 Schmidt ..... F28D 7/0066 165/157
2011/0240261 A1 * 10/2011 Ahlbeck ..... C09K 5/12 165/104.11
2012/0285423 A1 * 11/2012 Nguyen ..... F02B 29/0475 123/542

FOREIGN PATENT DOCUMENTS

JP S59-7892 A 1/1984
JP 2006038337 A 2/2006

* cited by examiner

TUBE BUNDLE DEVICE AND USE THEREOF

CROSS-REFERENCE TO RELATED APPLICATIONS

This application is a national stage application (under 35 U.S.C. § 371) of PCT/EP2014/057126, filed Apr. 9, 2014, which claims benefit of European Application No. 13163352.1, filed Apr. 11, 2013, both of which are incorporated herein by reference in their entirety.

The invention proceeds from a shell-and-tube apparatus comprising a housing having a bundle of tubes accommodated therein, where the tubes are joined at one end to a first tube plate and at the end opposite the first tube plate to a second tube plate, with the first and second tube plates being fastened detachably in the housing.

The invention also proceeds from a use of the shell-and-tube apparatus.

Shell-and-tube apparatuses are generally used where heat transfer from a first medium to a second medium has to take place. Apparatuses of this type are, for example, heat exchangers or reactors. In the shell-and-tube apparatus, the first medium flows through the tubes and the second medium flows through the space surrounding the tubes. The liquid can be conveyed in cocurrent, in countercurrent, in cross-cocurrent or in cross-countercurrent. In the case of flow in cross-cocurrent or cross-countercurrent, the individual tubes of the shell-and-tube apparatus are passed through deflection plates by means of which the second medium flowing around the tubes is deflected. The deflection along the deflection plates results in a meandering flow of the medium flowing around the tubes.

To avoid mixing of the first medium with the second medium, the ends of the tubes are usually accommodated in a fluid-tight manner in a tube plate. The tube plates are themselves likewise joined in a fluid-tight manner to a shell of the shell-and-tube apparatus.

In the case of shell-and-tube apparatuses used at present, the first tube plate and the second tube plate are each fixed in the housing of the shell-and-tube apparatus, with flange connections usually being used for this purpose. Customary configurations of the tube plates and the installation thereof are shown, for example, in Perry's Chemical Engineer's Handbook, Eighth Edition, pages 11-34.

A disadvantage of the known shell-and-tube apparatuses is that, especially at large temperature differences between the medium flowing through the tubes and the medium flowing around the tubes, longitudinal expansions of the tubes and of the shell are different, so that the tubes can deform in the shell-and-tube apparatus. In addition, it is generally not possible to replace tubes from the bundle of tubes in a simple manner if this should be necessary or cleaning work is to be carried out on the bundle of tubes or on the shell.

To avoid such deformation, compensators are generally used on the shell side of the apparatuses, but these can be used only for apparatuses having a limited wall thickness in the low-pressure range. These compensators are a known weak point of such constructions, and failure leads to escape of the medium in the shell space into the environment. This is an intolerable emission in cases in which process chemicals are handled on the shell side.

It is therefore an object of the present invention to provide a shell-and-tube apparatus which does not have the disadvantages known from the prior art.

The object is achieved by a shell-and-tube apparatus comprising a housing having a bundle of tubes accommodated therein, where the tubes are joined at one end to a first tube plate and at the end opposite the first tube plate to a second tube plate, with the first and second tube plates being fastened detachably in the housing, wherein the side of the first tube plate opposite the tubes rests against a stop on the housing and is fixed on the stop and the second tube plate is installed with a sealing element in the housing.

The fixing of the first tube plate at the stop prevents the bundle of tubes being able to move within the housing during operation of the shell-and-tube reactor. The installation of the second tube plate with a sealing element in the housing allows, for example in the case of different longitudinal expansion of tubes and housing, especially in the case of very different temperatures of the medium conveyed in the tubes and the medium flowing around the tubes, the tube plates to move within the housing and in this way compensate different longitudinal expansions caused by temperature differences. The sealing of the second tube plate by means of a gland seal allows, firstly, movement of the tube plate within the housing and, secondly, seals the spaces separated by the tube plate within the housing against one another. This ensures that a fluid from the space bounded by the tube plate and a housing lid flows into the tubes and also that the medium introduced into the housing, which flows around the tubes, cannot get into the feed stream into the tubes.

To prevent a fluid from being able to flow from the space between tube plates and housing lid into the space which surrounds the tubes and is defined by the housing shell and the two tube plates and secondly prevent the fluid from being able to flow from the space surrounding the tubes into the space between tube plates and housing lid on the side at which the tube plate is fixed at the stop, too, the first tube plate, too, is preferably sealed against the housing, with a gland seal likewise being able to be used here.

The use of a sealing element configured as a gland packing has the advantage that even when media are used under high pressure, for example a pressure of more than 100 bar, and in particular in the case of large pressure differences between the medium flowing through the tubes and the medium flowing around the tubes, satisfactory sealing between the spaces separated by the respective tube plates can be ensured.

The use of a sealing element configured as gland packing has, in particular, the advantage that media with relatively high pressure differences between shell and tube side can be separated without mixing of the streams occurring. At the same time, the gland packing, when made sufficiently large, accommodates, by compression, the increasing length of the bundle of tubes relative to the shell as a result of thermal stress. This is required on the shell side, especially in the case of apparatuses having a large wall thickness as are used predominantly in the medium- and high-pressure range, since in this case the tube side heats up significantly more quickly than the shell in the case of non-steady-state heating or cooling processes.

In a preferred embodiment, the stop against which the first tube plate rests comprises a divided ring which is accommodated in a groove in the housing. Here, the ring can be divided into two or more segments. Division of the ring into two or more segments allows the individual segments to be taken out of the housing so that the tube plate and thus the bundle of tubes can be moved freely in the housing after removal of the stop. This has the advantage that the bundle of tubes can be taken from the housing at both ends. It is thus firstly possible to withdraw the bundle of tubes from the housing, and secondly the bundle of tubes can also be pushed out of the housing.

To fix the first tube plate detachably against the stop, preference is given to the first tube plate being fixed by means of a locking element against the stop. The locking element is, for example, a further ring whose external diameter corresponds to the internal diameter of the shell and which rests against the stop on the side opposite the tube plate. Connection of the locking element to the tube plate is effected, for example, by means of clamping screws. For this purpose, it is possible, for example, for threaded openings into which the clamping screws are screwed to be provided in the tube plate. As an alternative, it is also possible, for example, to provide threaded rods on the tube plate, which rods can be passed through appropriate openings in the locking element and fixed by means of suitable nuts. As an alternative to a locking element configured in the form of a ring, it is also possible to provide a plurality of locking elements. It is thus also possible, for example, to provide a locking element, for example in the form of a clamping hook, in each case in the region of a fastening, for example a clamping screw or a threaded rod. As an alternative, it is also possible, for example, to utilize an appropriate washer which rests against the stop on the side opposite the tube plate. Here, it is, for example, possible to provide a washer for each clamping screw or each threaded rod. It is also possible to configure the washers so that a plurality of clamping screws or threaded rods are passed through a washer. Here, it is in each case necessary for the washers to be configured so that the feed opening into the individual tubes of the bundle of tubes remains free.

To prevent the medium which is to be conveyed through the tubes from getting into the region surrounding the tubes or the medium going in the opposite direction from the space surrounding the tubes into the region into which the tubes open, it is necessary for the first tube plate to be installed in a fluid-tight manner in the housing. In an embodiment of the invention, it is possible, for example, for the first tube plate to be pressed with a second sealing element against the stop. A suitable sealing element in this case is, for example, a flat seal or an appropriately dimensioned O ring. As an alternative, it is also possible for the second sealing element by means of which the first tube plate is sealed against the housing to be configured as a gland packing. Here, for example, the stop or the locking element can also be utilized to fix the gland packing.

The use of two tube plates which are installed at opposite sides of the housing makes it possible to use straight, i.e. uncurved, tubes. This has the advantage that the tubes can also be inspected, tested and cleaned without removal from the shell-and-tube apparatus. A further advantage of the use of straight tubes with tube plates which are located opposite one another and in which the respective ends of the tubes are mounted has the advantage that the respective tube plates have a uniform temperature profile and therefore no distortion, which leads to leakages, can occur. In contrast, in the case of U-shaped tubes, there would be a temperature gradient in the tube plate because of the temperature difference between inlet and outlet into/from the tubes and the installation of inlet and outlet in the same tube plate, and this can lead to distortion.

The use of straight tubes makes it possible, for example, to push a straight cleaning lance through the tube for testing or cleaning. In addition, a bundle of tubes having straight tubes can be produced more easily than a bundle of tubes having curved tubes since bending of the tubes is not necessary and the tubes can more easily be threaded into the tube plates.

A further advantage of the shell-and-tube apparatus of the invention is that the use of two tube plates and straight tubes makes it possible to utilize a cylindrical housing, so that the bundle of tubes can be pulled out or alternatively pushed out from the housing on both sides.

As a result of the use of the two tube plates, the shell-and-tube apparatus is divided into three separate regions. At each of the end faces, there is a space into which the tubes open, with one forming the inlet into the tubes and the other forming the outlet from the tubes. In the middle, there is a further region which encloses the tubes and in which a second medium can flow.

The configuration of the shell-and-tube apparatus in such a way that the second tube plate is installed with a sealing element in the housing has the advantage that, for example, different materials having different thermal expansions can be used for housing and tubes and a seal between the individual regions into which the shell-and-tube apparatus is divided is always ensured by the movability of the tube plate having a suitable sealing element. In the case of different longitudinal expansion, for example at high temperatures, the second tube plate moves in the housing so that tensile or compressive stress on tubes or housing does not occur and deformation which could arise as a result likewise does not occur. A further advantage is that long lengths of the tube are also possible without deformation of the tubes or the housing occurring during operation of the shell-and-tube apparatus, for example under high pressure or at high temperatures, because of the movable tube plates.

The shell-and-tube apparatus of the invention is usually employed in plants in which a gaseous or liquid stream has to be heated or cooled under a relatively high operating pressure. Here, the shell-and-tube apparatus can be used either as shell-and-tube reactor or preferably as heat exchanger or recuperator in heat integration. The shell-and-tube apparatus of the invention is particularly useful when large dimensions, for example long tubes, are required. It is also particularly advantageous to use the shell-and-tube apparatus of the invention when large temperature differences between the media conveyed in the shell-and-tube apparatus occur or the media are passed through the shell-and-tube apparatus with high temperatures. For the purposes of the present invention, high temperature differences over the apparatus are temperature differences in the range from 50 to 350° C., preferably in the range from 50 to 200° C. High temperatures are, for the purposes of the present invention, temperatures in the range from 100 to 500° C., preferably in the range from 100 to 350° C.

For the purposes of the present invention, the expression "relatively high operating pressure" refers to pressures at which the shell-and-tube apparatus can be operated structurally advantageously. These are, for example, in the range from 60 to 500 bar, preferably in the range from 100 to 350 bar. Differential pressures between shell and tube side can be up to 100 bar.

Of course, the shell-and-tube apparatus of the invention can also be operated at low temperature differences or low temperatures or small differential pressures or low pressures. Operation of the reactor of the invention is not restricted to processes in which high pressure or temperature differences or high pressures or temperatures occur. However, due to its configuration, it is particularly suitable for operation at high pressures and/or temperatures.

The shell-and-tube apparatus of the invention is particularly useful in processes in which the heat of reaction of an exothermic reaction of an adiabatically operated reactor system is to heat the feed to the reactor to the reaction temperature. In this arrangement, the reactor outflow comprising the reaction enthalpy is conveyed on one of the two sides of the shell-and-tube apparatus, while the reactor feed is passed through the other side with heating of the system.

The apparatus of the invention is particularly suitable for use as heat exchanger, for example in a process for preparing tertiary butylamine. Here, the shell-and-tube apparatus is used as heat exchanger for heating the feed streams to the intended reactor inlet temperature in the range from 230 to 320° C., for example 300° C. The feed streams are each heated to the reactor inlet temperature in a heat exchanger and fed to the reactor. The reaction to form tertiary butylamine then occurs in the reactor.

Illustrative examples of the invention are depicted in the figures and are explained in more detail in the following description.

Figure 2:
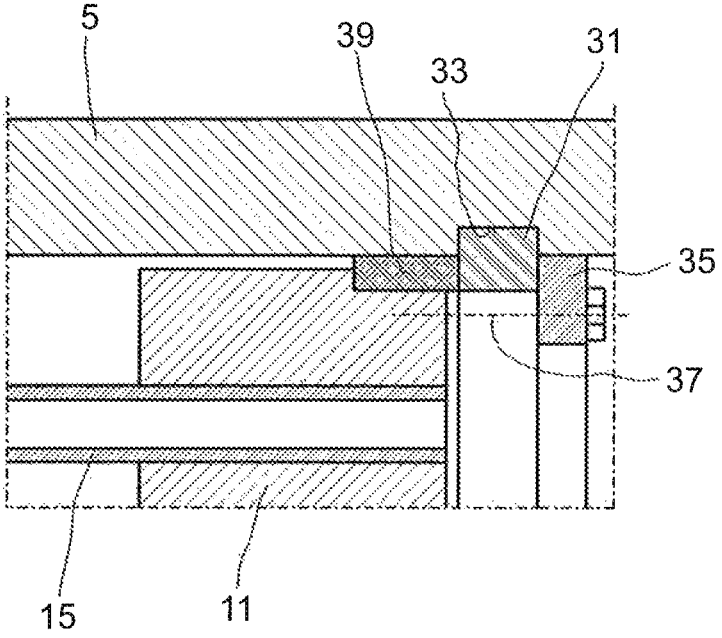

The figures show:

FIG. 1 a sectional view of a shell-and-tube apparatus,

FIG. 2 part of the tube plate fixed at a stop.

Figure 3:
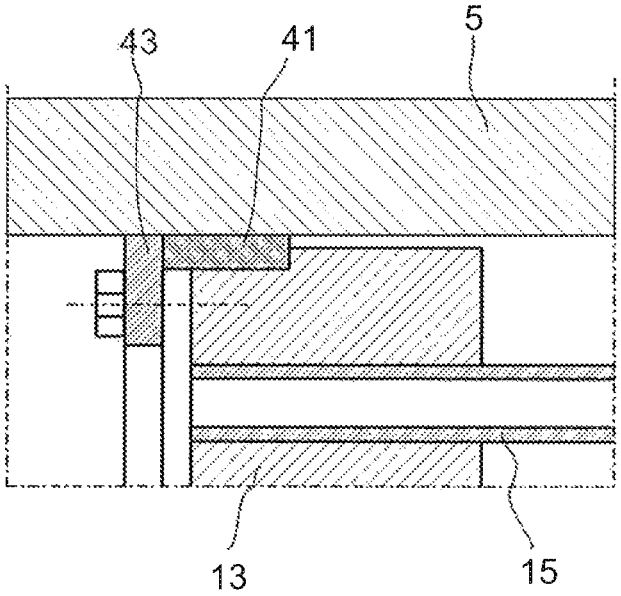

FIG. 3 part of the tube plate installed in the housing.

In FIG. 1, a shell-and-tube apparatus is depicted in section.

A shell-and-tube apparatus 1 comprises a housing 3 which comprises a shell 5 which is closed at each end by a lid 7. The shell 5 is usually cylindrical but can also assume any other cross section in addition to a circular cross section.

The lids 7 are each usually fastened to the shell 5 by means of a flange connection.

A bundle 9 of tubes is accommodated in the housing 3. The bundle 9 of tubes comprises a first tube plate 11, a second tube plate 13 and tubes 15. The ends of the tubes 15 are each fixed in one of the two tube plates 11, 13. Here, the tubes 15 are preferably fixed in the tube plates 11, 13 so that they each end flush with the tube plate 11, 13. In this way, liquid remaining standing on the tube plates and not being able to flow into the tubes 15 is prevented during upright operation of the shell-and-tube apparatus 1.

The tube plates 11, 13 are connected in a fluid-tight manner to the housing 3. According to the invention, the first tube plate 11 is fixed detachably to the housing 3 and the second tube plate 13 is positioned movably in the shell 5 of the housing 3. The tube plates 11, 13 divide the housing 3 into three regions. A first region 17 and a second region 19 are in each case located at the outsides of the apparatus so that the tubes 15 each open into one of the two regions 17, 19. There is a middle region 21 which is closed off on the two sides by the first tube plate 11 and the second tube plate.

To operate the shell-and-tube apparatus 1, a connection 23 is provided in each of the lids 7. Here, a first fluid, which can be liquid or gaseous, is fed in through one of the two connections 23 and goes into the first region 17 or the second region 19 and from there into the tubes 15. The medium flows through the tubes and goes into the respective other region 19, 17 and leaves the shell-and-tube apparatus through the second connection 23. A second medium which flows around the tubes is introduced via an inlet 25 which opens into the middle region 21 surrounding the tubes and taken off from the middle region via an outlet 27.

When the shell-and-tube apparatus 1 is used as heat exchanger, it is possible, for example, to heat or cool the first medium which flows through the tubes. For this purpose, a heat transfer medium is passed through the middle region 21. When the medium fed into the tubes is to be heated, the medium conveyed through the middle region has a higher temperature than the medium to be heated, and when the medium conveyed through the tubes is to be cooled, the temperature of the medium introduced into the middle region 21 is lower. The media conveyed through the shell-and-tube apparatus 1 can be conveyed in cocurrent, in countercurrent or in cross-cocurrent or in cross-countercurrent. When the streams flow in cross-cocurrent or in cross-countercurrent, deflection plates 29 are usually provided in the middle region 21 in order to deflect the fluid.

For the bundle of tubes not to be shifted within the housing 3 during operation, it is necessary for one of the two tube plates 11, 13 to be fixed to the housing 3. A part of a tube plate fixed in a housing by means of a stop is shown by way of example in FIG. 2. To fix the first tube plate 11 on the housing 3, preferably on the shell 5, the first tube plate 11 is fixed against a stop 31. The stop 31 can, for example, as shown in FIG. 2, be configured as a ring which is located in a groove 33. To make simple installation of the stop 31 and the first tube plate 11 possible, preference is given to the stop 31 being configured as a divided ring. Here, the stop 31 can have two or more segments. Preference is given to the stop 31 having more than two segments since in this case simpler installation is possible.

In order to fix the first tube plate 11 against the stop 31, a locking element 35 is positioned on the side of the stop 31 opposite the first tube plate 11. Clamping screws 37, for example, are passed through the locking element 35 and are screwed by means of a thread into the first tube plate 11. As an alternative, it is also possible to provide threaded rods on the first tube plate and pass these through a hole in the locking element 35 and fix them by means of a nut. Fastening by means of clamping screws 37 or by means of a threaded rod allows simple detachment of the tube plate, for example, in order to remove the bundle of tubes from the housing 3.

To obtain a fluid-tight connection between tube plate 11 and housing 3 or shell 5, the first tube plate 11 is provided with a sealing element 39. The sealing element 39 can, for example, be a flat seal or an O-ring or, as shown in FIG. 2, a gland packing. In this case, the sealing element 39 configured as gland packing is introduced into a groove of the tube plate and pressed against the stop 31 so that a fluid-tight connection between tube plate 11 and shell 5 is produced. This firstly prevents fluid being able to flow from the first or second region into which the tubes 15 which are passed through the tube plate 11 open into the middle region 21 or liquid being able to get from the middle region 21 into the first or second region into which the tubes open.

According to the invention, the second tube plate 13 is mounted movably in the housing 3. This is shown by way of example in FIG. 3.

Unlike the first tube plate 11 which is fixed to the housing, the second tube plate 13 is mounted movably in the housing.

To prevent fluid from being able to get from the middle region into the outer region into which the tubes 15 open or being able to flow from the outer region into the middle region 21, the second tube plate 13 is installed with a sealing element 41 in the shell 5. The sealing element 41 rests with one side against the shell 5. A suitable sealing element 41 is, for example, a gland packing which is pressed by means of a gland flange 43. In this way, the gland packing of the sealing element is pressed against the housing shell 5 so as to give a fluid-tight connection. Nevertheless, the tube plate 13 is still able to move in the shell, so that, for example, length changes of the tubes 15 occurring as a result of pressure or temperature differences can be compensated by movement of the second tube plate 13. This allows, in particular, construction of shell-and-tube apparatuses having very long tubes or having tubes and housing made of different materials which have different longitudinal thermal expansions.

To remove the bundle of tubes from the shell-and-tube apparatus 1, the connection produced by the clamping screw 37 or the threaded rod is released, the locking element 35 is removed and the stop 31 is taken out from the groove. The first tube plate 11 can then be moved in the housing so that the bundle 9 of tubes can be pulled or pushed out of the shell 5.

As material for the tubes, it is possible to use any material from which tubes can be manufactured. When the shell-and-tube apparatus 1 is to be used as heat exchanger, preference is given to using a material which has good thermal conductivity for the tubes. Preference is given to using a metal. Suitable metals for the tubes 15 of the bundle of tubes are, for example, ferrous metals such as steels or else copper or aluminum. The housing can likewise be made of corresponding metals. However, apart from metals, the tubes and the housing can also be made of plastic, glass or ceramic. The suitable material for the tubes and housing is also dependent on the media which are to be conveyed through the tubes or through the middle region in the housing.

LIST OF REFERENCE NUMERALS

1 Shell-and-tube apparatus
3 Housing
5 Shell
7 Lid
9 Bundle of tubes
11 First tube plate
13 Second tube plate
15 Tube
17 First region
19 Second region
21 Middle region
23 Connection
25 Inlet
27 Outlet
29 Deflection plate
31 Stop
33 Groove
35 Locking element
37 Clamping screw
39 Sealing element
41 Sealing element
43 Gland flange

The invention claimed is:

1. A shell-and-tube apparatus comprising a housing having a bundle of tubes accommodated therein, where the tubes are joined on one side to a first tube plate and on a side opposite the first tube plate to a second tube plate, with the first and second tube plates being fastened detachably in the housing, and a side of the first tube plate opposite the tubes rests against a stop on the housing and is fastened on the stop and the second tube plate is installed with a sealing element in the housing, wherein the stop comprises a divided ring which is accommodated in a groove on an inner surface of the housing, the ring being divided into segments to allow the individual segments to be taken out of the housing, wherein the side of the first tube plate opposite the tubes rests against the divided ring, and wherein the second tube plate is movable within the housing to compensate different longitudinal expansions caused by temperature differences.

2. The shell-and-tube apparatus according to claim 1, wherein the sealing element with which the second tube plate is installed in the housing is configured as gland packing.

3. The shell-and-tube apparatus according to claim 1, wherein the first tube plate is fixed with a locking element (35) against the stop.

4. The shell-and-tube apparatus according to claim 3, wherein the locking element is a ring which is connected by means of clamping screws to the tube plate in such a way that the tube plate is fixed on one side against the stop and the locking element rests against the stop on the side opposite the tube plate.

5. The shell-and-tube apparatus according to claim 1, wherein the first tube plate is pressed with a second sealing element against the stop.

6. The shell-and-tube apparatus according to claim 5, wherein the second sealing element is configured as gland packing.

7. The shell-and-tube apparatus according to claim 1, wherein the shell-and-tube apparatus is a heat exchanger or recuperator in heat integration.

8. The shell-and-tube apparatus according to claim 7, wherein at least one medium flowing through the heat exchanger has a temperature in the range from 100 to 500° C.

9. The shell-and-tube apparatus according to claim 7, wherein at least one medium flowing through the heat exchanger has a pressure in the range from 60 to 500 bar.

* * * * *